United States Patent [19]

Ogawa et al.

[11] Patent Number: 4,770,983

[45] Date of Patent: Sep. 13, 1988

[54] ARYLOXY COUPLING OFF GROUP YELLOW COUPLES IN SILVER HALIDE PHOTOGRAPHIC MATERIAL

[75] Inventors: Akira Ogawa; Hiroshi Fukuzawa, both of Kanagawa, Japan

[73] Assignee: Fuji Photo Film Co., Ltd., Kanagawa, Japan

[21] Appl. No.: 84,230

[22] Filed: Aug. 11, 1987

[30] Foreign Application Priority Data

Aug. 11, 1986 [JP] Japan ..... 61-187995

[51] Int. Cl.[4] ..... G03C 7/36

[52] U.S. Cl. ..... 430/505; 430/546; 430/550; 430/557

[58] Field of Search ..... 430/557, 389, 505, 546, 430/550

[56] References Cited

U.S. PATENT DOCUMENTS

| | | | |
|---|---|---|---|
| 3,408,194 | 10/1968 | Loria | 430/557 |
| 3,894,875 | 7/1975 | Cameron et al. | 430/557 |
| 3,933,501 | 1/1976 | Cameron et al. | 430/505 |
| 4,401,752 | 8/1983 | Lau | 430/557 |

OTHER PUBLICATIONS

U.S. patent application Ser. No. 07/046,750, Ogawa et al, filed 5-7-87.

*Primary Examiner*—Richard L. Schilling
*Attorney, Agent, or Firm*—Sughrue, Mion, Zinn, Macpeak & Seas

[57] ABSTRACT

A silver halide color photographic material comprising a support having thereon at least one silver halide emulsion layer, wherein the silver halide color photographic material contains at least one yellow dye-forming coupler represented by the formula (I)

(I)

wherein $R_1$ represents a substituted or unsubstituted tertiary alkyl group or a substituted or unsubstituted aryl group; $R_2$ represents a chlorine atom or an alkoxy group; $R_3$ represents a straight chain or branched chain alkyl group having from 8 to 26 carbon atoms; $R_4$ represents a branched alkyl group having from 3 to 12 carbon atoms; and $R_5$ represents a hydrogen atom or a halogen atom.

The yellow dye-forming coupler represented by the formula (I) is excellent in solubility, dispersion stability and spectral absorption characteristics, has a good coupling reactivity which is not severely influenced by variations in pH of the color developing solution, and provides a yellow color image having high color density and excellent stability.

A method for forming a yellow dye image in the presence of the yellow dye-forming coupler represented by the formula (I) is also disclosed.

22 Claims, No Drawings

ARYLOXY COUPLING OFF GROUP YELLOW COUPLES IN SILVER HALIDE PHOTOGRAPHIC MATERIAL

FIELD OF THE INVENTION

The present invention relates to a coupler for forming a color photographic image, and more particularly to a novel yellow dye-forming coupler.

More specifically, it relates to a method for forming a yellow dye image in the presence of a novel yellow coupler which is excellent in solubility, dispersion stability, and spectral absorption characteristics, has a coupling reactivity which is not severely influenced by variations of pH of the color developing solution, and provides a yellow color image having a high color density and excellent image preservability.

BACKGROUND OF THE INVENTION

In the subtractive color process, as is well known in the art, a yellow, cyan, or magenta dye-forming coupler (also referred to herein more briefly as yellow, cyan, and magenta couplers) undergoes oxidative coupling in a silver halide emulsion with an oxidation product of an aromatic primary amine color developing agent which is formed by reduction of exposed silver halide grains with the color developing agent to form a color image.

In such a system, a compound having an active methylene group is generally used as a yellow coupler for forming a yellow dye; a compound of a pyrazolone type, a pyrazolobenzimidazole type, or a pyrazoloazole type, etc., is used as a magenta coupler for forming a magenta dye; and a compound having a phenolic or naphtholic hydroxy group is used as a cyan coupler for forming a cyan dye.

Each of these couplers is dissolved in a substantially water-insoluble organic solvent having a high boiling point or a mixture thereof together with an auxiliary solvent, if desired, and added to a silver halide emulsion, or it is added to the silver halide emulsion in the form of an alkaline aqueous solution thereof. In general, the former is superior to the latter with respect to fastness to light, humidity and heat, graininess and sharpness of color, etc.

In addition to the fundamental property cf dye formation, various characteristics are required for such a coupler. Namely, it should have a high solubility in an organic solvent having a high boiling point or an alkaline aqueous solution, it should have good dispersibility and stability in a silver halide photographic emulsion, a dye formed therefrom should be fast to light, heat and humidity, should have excellent spectral absorption characteristics and good transparency, an image formed therefrom should have good sharpness, and importantly, it should have a high color forming density, a high dye forming rate, etc.

Moreover, since conventional yellow couplers usually have high pH dependency, it is necessary to control very carefully the pH condition of the color developing solution. However, the optimum value of pH of the color developing solution is ordinarily varied to some extent depending on the color developing agent used, the coupler used, or the combination of couplers used. Therefore, a yellow coupler which has a low pH dependency is desired.

As a skeleton structure of a yellow coupler, a pivaloylacetanilide type, a benzoylacetanilide type, a malondiester type, a malondiamide type, a dibenzoylmethane type, a benzothiazolyl acetamide type, a malonic ester monoamide type, a benzothiazolyl acetate type, a benzoxazolyl acetamide type, a benzoxazolyl acetate type, a benzimidazolyl acetamide type, or a benzimidazolyl acetate type, etc., are known. Of these couplers, benzoylacetanilide type couplers and pivaloylacetanilide type couplers are advantageous.

Specific examples of these yellow couplers are described in U.S. Pat. Nos. 2,875,057, 3,265,506, 3,408,194, 3,551,155, 3,582,322, 3,725,072, 4,356,258 and 3,891,445, West German Patent No. 1,547,868, West German Patent Application (OLS) Nos. 2,219,917, 2,261,361 and 2,414,006, British patent No. 1,425,020, Japanese patent Publication No. 10783/76, Japanese Patent Application (OPI) Nos. 26133/72, 73147/73, 102636/76, 6341/75, 123342/75, 130442/75, 21827/76, 87650/75, 82424/77 and 115219/77, etc. (the term "OPI" as used herein refers to a "published unexamined Japanese patent application").

For the purpose of development of α-benzoylacetanilide type and α-pivaloylacetanilide type yellow couplers which satisfy the above-described various requirements, several attempts to modify the structure of the sulfonamido group which is introduced into the anilide nucleus have been hitherto made.

For instance, in U.S. Pat. Nos. 3,933,501 and 3,894,875, yellow couplers are described which have an alkylsulfonamido bond, an alkarylsulfonamido bond, an aralkylsulfonamido bond, a phenylsulfonamido bond or an alkoxyphenylsulfonamido bond at the 5-position of α-pivaloylacetanilide and in which one of the hydrogen atoms of the active position is substituted with a phenoxy group having a carboxy group, a nitro group, a 4-benzyloxyphenylsulfonyl group, a 2-alkoxyphenylsulfamoyl group, an alkylsulfamoyl group, a 4-hydroxyphenylsulfonyl group, an alkylphenylsulfonyl group, a phenylsulfonyl group, an alkylsulfonyl group, or a cyano group at the 4-position thereof. Of these yellow couplers, those having a 4-hydroxyphenylsulfonylphenoxy group at the coupling active position exhibit a relatively high activity. However, they are susceptible to the change in pH of the color developing solution, and thus have a defect in that properties of dye images obtained therefrom widely fluctuate, and they have another problem in that they have a poor solubility in an organic solvent having a high boiling point.

Also, couplers having a 4-benzyloxyphenylsulfonylphenoxy group at the coupling active position are disadvantageous because of their extremely low solubility in an organic solvent having a high boiling point.

In Japanese Patent Application (OPI) No. 142340/80 (corresponding to European patent No. 17,833A1), α-acylacetanilide yellow couplers having an alkoxyalkylsulfonamido group at a non-coupling position are described. According to the description made therein, these yellow couplers have a low melting point by introducing an ether bond into a hydrophobic alkyl portion of the alkylsulfonamido group, and as the result they have an improved solubility in an organic solvent having a high boiling point. However, as is apparent from the example shown hereinafter, their color forming property is not necessarily sufficient, and dyes formed therefrom are less fast to light. In particular, they have a problem in that their coupling activity decreases as the reduction of a rate of an organic solvent having a high boiling point to a yellow coupler.

In Japanese Patent Application (OPI) No. 21738/83, α-acylacetanilide yellow couplers are described having an alkylsulfonamido group which is substituted with a specific substituent (for example, an alkylthio group, an alkylsulfonyl group, an acyloxy group, an alkoxycarbonyl group, an amino group, a carbamoyl group, an imido group, a sulfonamido group, etc.). However, these couplers have only a poor solubility in an organic solvent having a high boiling point and dyes formed therefrom are less fast to light. Also, they have, disadvantageously, a low coupling activity.

In Japanese Patent Application (OPI) No. 121126/79 (corresponding to British Patent No. 2,018,445A), α-acylacetanilide yellow couplers are described having a sulfonamido group which is substituted with a substituent (for example, a cyano group, a halogen atom, an alkyl group, an aryl group, a heterocyclic residue, etc.) at its nitrogen atom. However, they have only a low coupling reactivity and dyes formed therefrom do not have necessarily sufficient fastness to light, heat and humidity.

In Japanese Patent Application (OPI) No. 42046/83, α-acylacetanilide yellow couplers are described having three substituents, that is, a halogen atom or an alkoxy group at the 2-position thereof; a halogen atom, an alkyl group or an alkoxy group; and an alkylsulfonamido group or an alkylsulfonamido group substituted with a phenyl group. However, these couplers have large defects in that they are difficult to dissolve in an organic solvent having a high boiling point and in that dyes formed therefrom have only a low fastness to light.

Further, in U.S. Pat. No. 4,401,752, α-pivaloylacetanilide yellow couplers are described having at the coupling position an aryloxy group which is substituted at the ortho position to the oxygen atom of the aryloxy group with a carbonyl group, a sulfonyl group or a phosphinyl group and having at the 5-position of the acetanilide an alkylsulfonamido group. However, these couplers are disadvantageous because of their low solubility in an organic solvent having a high boiling point.

As described above, yellow couplers which fully satisfy all of the above-described requirements have not yet been provided.

SUMMARY OF THE INVENTION

Therefore, an object of the present invention is to provide a novel yellow coupler which is excellent in solubility in an organic solvent having a high boiling point, and in dispersibility and stability in a silver halide color photographic emulsion.

Another object of the present invention is to provide a novel yellow coupler which has a sufficient coupling activity even when the amount of an organic solvent having a high boiling point is reduced, which thus is capable of allowing reduction of thickness of the layer in which it is incorporated.

A further object of the present invention is to provide a novel yellow coupler which is not susceptible to the variation of pH of a color developing solution and forms a dye image of reduced fluctuations in its image density.

A still further object of the present invention is to provide a novel yellow coupler which forms a dye image having excellent preservability, that is, fastness to light, heat and humidity.

Other objects of the present invention will become apparent from the following description and examples.

It has now been found that these objects of the present invention are attained by using a yellow dye-forming coupler represented by the formula (I)

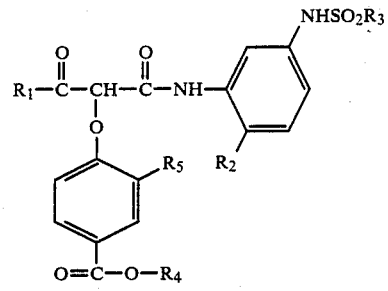

(I)

wherein $R_1$ represents a substituted or unsubstituted tertiary alkyl group or a substituted or unsubstituted aryl group; $R_2$ represents a chlorine atom or an alkoxy group; $R_3$ represents a straight chain or branched chain alkyl group having from 8 to 26 carbon atoms; $R_4$ represents a branched alkyl group having from 3 to 12 carbon atoms; and $R_5$ represents a hydrogen atom or a halogen atom.

DETAILED DESCRIPTION OF THE INVENTION

In accordance with the present invention, a dye image can be formed by development of an imagewise exposed silver halide photographic emulsion layer with an aromatic primary amine developing agent in the presence of the yellow coupler represented by the formula (I) described above.

The present invention provides a silver halide color photographic material containing at least one yellow coupler represented by the formula (I) described above in at least one layer thereof.

The yellow coupler represented by the formula (I) is described in more detail below.

In the formula (I), the tertiary alkyl groups represented by $R_1$ include an unsubstituted alkyl group (for example, a tert-butyl group, etc.) and a substituted alkyl group. Suitable examples of the substituents for the above-described substituted alkyl group include a halogen atom (for example, a fluorine atom, a chlorine atom, a bromine atom, etc.), an alkoxy group (for example, a methoxy group, an ethoxy group, etc.), an aryloxy group (for example, a phenoxy group, a 4-chlorophenoxy group, etc.), an arylthio group (for example, a phenylthio group, etc.), an alkylthio group (for example, an ethylthio group, an n-butylthio group, etc.), an alkylsulfonyl group (for example, a methanesulfonyl group, etc.), an arylsulfonyl group (for example, a benzenesulfonyl group, etc.), an acylamino group (for example, an acetamido group, etc.), an amino group (for example, a diethylamino group, etc.) or a cyano group, etc.

The aryl group represented by $R_1$ is preferably a phenyl group which may be substituted. Suitable examples of the substituents for the above-described substituted aryl group include those as described for the substituted alkyl group described above, and, in addition, an alkyl group (for example, a methyl group, an ethyl group, a tert-butyl group, etc.).

$R_2$ in the formula (I) represents a chlorine atom or an alkoxy group (for example, a methoxy group, an ethoxy group, etc.).

$R_3$ in the formula (I) represents a straight chain or branched chain alkyl group having from 8 to 26 carbon atoms (for example, an n-octyl group, a 2-ethylhexyl group, an n-dodecyl group, an n-decyl group, an n-hexadecyl group, an n-octadecyl group, an n-tetradecyl group, etc.).

$R_4$ in the formula (I) represents a branched chain alkyl group having from 3 to 12 carbon atoms (for example, an isopropyl group, an isobutyl group, a sec-butyl group, a tert-butyl group, a neopentyl group, a tert-pentyl group, an isohexyl group, a 2-methylpentyl group, a 2-ethylhexyl group, etc.).

$R_5$ in the formula (I) represents a hydrogen atom or a halogen atom (for example, a chlorine atom a bromine atom, etc.).

The yellow dye-forming coupler represented by the formula (I) described above is characterized in that a chlorine atom or an alkoxy group is present at the 2-position of an α-acylacetanilide, an alkylsulfonamido group is present at the 5-position of the α-acylacetanilide, and the active position is substituted with a phenoxy group having a branched chain alkoxycarbonyl group at the 4-position of the phenoxy group. It is believed that based on such a feature of the structure, various preferred characteristics are obtained.

Of the yellow couplers which can be used in the present invention, more preferred compounds are those represented by the formula (II)

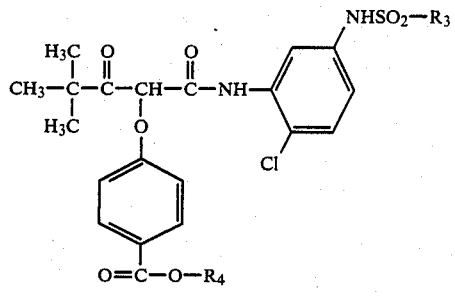

(II)

wherein $R_3$ and $R_4$ each has the same meaning as defined in the formula (I).

It is particularly preferred that $R_3$ represents a straight chain alkyl group having from 10 to 16 carbon atoms and $R_4$ represents a branched chain alkyl group having from 3 to 8 carbon atoms in the formula (II).

Representative specific examples of the yellow couplers according to the present invention are set forth below, but the present invention is not to be construed as being limited thereto.

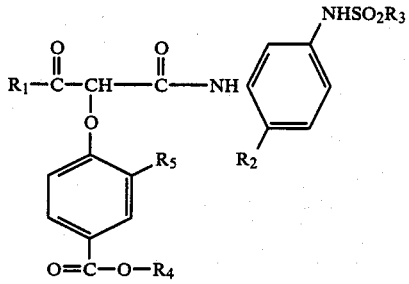

| No. | $R_1$ | $R_2$ | $R_3$ | $R_4$ | $R_5$ |
|---|---|---|---|---|---|
| 1 | $(CH_3)_3C$— | Cl | $-C_{16}H_{33}(n)$ | $-CH(CH_3)_2$ | H |
| 2 | $(CH_3)_3C$— | Cl | $-C_{16}H_{33}(n)$ | $-CH_2CH(CH_3)_2$ | H |
| 3 | $(CH_3)_3C$— | Cl | $-C_{16}H_{33}(n)$ | $-C(CH_3)_3$ | H |
| 4 | $(CH_3)_3C$— | Cl | $-C_{16}H_{33}(n)$ | $-(CH_2)_2CH(CH_3)_2$ | H |
| 5 | $(CH_3)_3C$— | Cl | $-C_{16}H_{33}(n)$ | $-CH(C_2H_5)_2$ | H |
| 6 | $(CH_3)_3C$— | Cl | $-C_{16}H_{33}(n)$ | $-CH_2CH(C_2H_5)_2$ | H |
| 7 | $(CH_3)_3C$— | Cl | $-C_{16}H_{33}(n)$ | $-(CH_2)_3CH(CH_3)_2$ | H |
| 8 | $(CH_3)_3C$— | Cl | $-C_{16}H_{33}(n)$ | $-CH(CH_3)C_2H_5$ | H |
| 9 | $(CH_3)_3C$— | Cl | $-C_{16}H_{33}(n)$ | $-CH_2CH(C_2H_3)(CH_2)_2CH_3$ | H |
| 10 | $(CH_3)_3C$— | Cl | $-C_{16}H_{33}(n)$ | $-(CH_2)_4CH(CH_3)_2$ | H |
| 11 | $(CH_3)_3C$— | Cl | $-C_{16}H_{33}(n)$ | $-CH_2CH(C_2H_5)(CH_2)_3CH_3$ | H |
| 12 | $(CH_3)_3C$— | Cl | $-C_{12}H_{25}(n)$ | $-CH(CH_3)_2$ | H |
| 13 | $(CH_3)_3C$— | Cl | $-C_{12}H_{25}(n)$ | $-CH_2CH(CH_3)_2$ | H |
| 14 | $(CH_3)_3C$— | Cl | $-C_{12}H_{25}(n)$ | $-C(CH_3)_3$ | H |
| 15 | $(CH_3)_3C$— | Cl | $-C_{12}H_{25}(n)$ | $-CH(CH_3)C_2H_5$ | H |

-continued

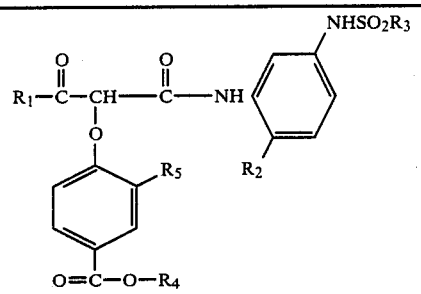

| No. | $R_1$ | $R_2$ | $R_3$ | $R_4$ | $R_5$ |
|---|---|---|---|---|---|
| 16 | $(CH_3)_3C-$ | Cl | $-C_{12}H_{25}(n)$ | $-CH_2CH_2CH(CH_3)_2$ | H |
| 17 | $(CH_3)_3C-$ | Cl | $-C_{12}H_{25}(n)$ | $-CH(C_2H_5)_2$ | H |
| 18 | $(CH_3)_3C-$ | Cl | $-C_{12}H_{25}(n)$ | $-CH_2CH(CH_3)(C_2H_5)$ | H |
| 19 | $(CH_3)_3C-$ | Cl | $-C_{12}H_{25}(n)$ | $-C(CH_3)_2(C_2H_5)$ | H |
| 20 | $(CH_3)_3C-$ | Cl | $-C_{12}H_{25}(n)$ | $-CH_2CH(CH_3)_2$ | H |
| 21 | $(CH_3)_3C-$ | Cl | $-C_{12}H_{25}(n)$ | $-CH_2CH(C_2H_5)_2$ | H |
| 22 | $(CH_3)_3C-$ | Cl | $-C_{12}H_{25}(n)$ | $-(CH_2)_3CH(CH_3)_2$ | H |
| 23 | $(CH_3)_3C-$ | Cl | $-C_{12}H_{25}(n)$ | $-CH_2CH(C_2H_3)(CH_2)_2CH_3$ | H |
| 24 | $(CH_3)_3C-$ | Cl | $-C_{12}H_{25}(n)$ | $-(CH_2)_4CH(CH_3)_2$ | H |
| 25 | $(CH_3)_3C-$ | Cl | $-C_{12}H_{25}(n)$ | $-CH_2CH(C_2H_5)C_4H_9(n)$ | H |
| 26 | $(CH_3)_3C-$ | Cl | $-C_{12}H_{25}(n)$ | $-(CH_2)_5CH(CH_3)_2$ | H |
| 27 | $(CH_3)_3C-$ | Cl | $-C_{12}H_{25}(n)$ | $-(CH_2)_2CH(CH_3)CH_2C(CH_3)_2$ | H |
| 28 | $ClCH_2C(CH_3)_2-$ | Cl | $-C_{16}H_{33}(n)$ | $-CH(CH_3)_2$ | Cl |
| 29 | $ClCH_2C(CH_3)_2-$ | Cl | $-C_{12}H_{25}(n)$ | $-CH(CH_3)_2$ | H |
| 30 | $-OCH_2C(CH_3)_2$ | Cl | $-C_8H_{17}(n)$ | $-CH(CH_3)_2$ | H |
| 31 | $-OCH_2C(CH_3)_2$ | $-OCH_3$ | $-C_{14}H_{29}(n)$ | $-CH(CH_3)_2$ | H |
| 32 | $-OCH_2C(CH_3)_2$ | $-OCH_3$ | $-(CH_2)_2CH(CH_3)CH_2C(CH_3)_3$ | $-CH(CH_3)_2$ | H |

-continued
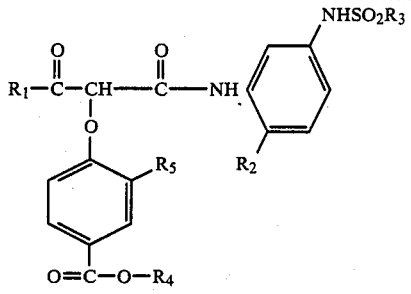
| No. | $R_1$ | $R_2$ | $R_3$ | $R_4$ | $R_5$ |
|---|---|---|---|---|---|
| 33 | $CH_3OCH_2C(CH_3)_2$ | Cl | $-C_{14}H_{29}(n)$ | $-CH_2CH(CH_3)_2$ | H |
| 34 | $(n)C_4H_9OCH_2C(CH_3)_2$ | Cl | $-C_{18}H_{37}(n)$ | $-(CH_2)_2CH(CH_3)_2$ | H |
| 35 | $-SO_2CH_2C(CH_3)_2$ | Cl | $-C_{12}H_{25}(n)$ | $-(CH_2)_2CH(CH_3)_2$ | H |
| 36 | $CH_3SO_2CH_2C(CH_3)_2$ | Cl | $-C_{12}H_{25}(n)$ | $-(CH_2)_2CH(CH_3)_2$ | H |
| 37 | $Cl-OCH_2C(CH_3)_2$ | Cl | $-C_{12}H_{25}(n)$ | $-(CH_2)_2CH(CH_3)_2$ | H |
| 38 | $(CH_3)_3C-$ | $-OC_2H_5$ | $-C_{12}H_{25}(n)$ | $-CH(CH_3)_2$ | Cl |
| 39 | $(CH_3)_3C-$ | Cl | $-C_{12}H_{25}(n)$ | $-CH(CH_3)_2$ | Cl |
| 40 | $O, N-CH_2C(CH_3)_2$ | Cl | $-C_{14}H_{29}(n)$ | $-CH(CH_3)_2$ | H |
| 41 | $OC_4H_9(n)$, $-SO_2-CH_2C(CH_3)_2$, $C_8H_{17}(t)$ | Cl | $-C_{16}H_{37}(n)$ | $-CH(CH_3)_2$ | H |
| 42 | $OC_4H_9(n)$, $-SO_2-CH_2C(CH_3)_2$, $C_8H_{17}(t)$ | Cl | $-C_{12}H_{24}(n)$ | $-CH(CH_3)_2$ | H |

-continued

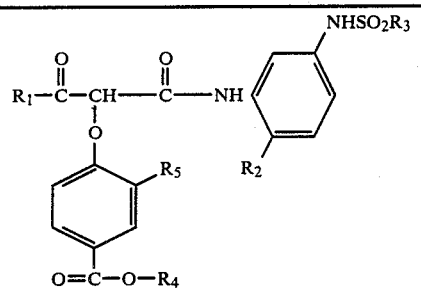

| No. | $R_1$ | $R_2$ | $R_3$ | $R_4$ | $R_5$ |
|---|---|---|---|---|---|
| 43 | $(n)C_4H_9SO_2CH_2C(CH_3)_2$ | Cl | $-C_{12}H_{24}(n)$ | $-CH_2CH(C_2H_3)(CH_2)_3CH_3$ | H |

The novel yellow coupler represented by the formula (I) according to the present invention can be prepared, for example, by reacting an α-halogeno-α-acylacetanilide represented by the formula (IIIa)

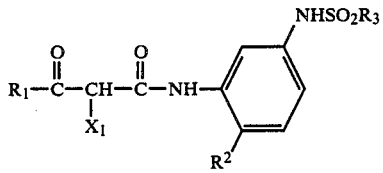

(IIIa)

wherein $X_1$ represents a halogen atom (for example, a chlorine atom, a bromine atom, etc.); and $R_1$, $R_2$ and $R_3$ each has the same meaning as defined above; with a 4-alkoxycarbonylphenol represented by the formula (IIIb)

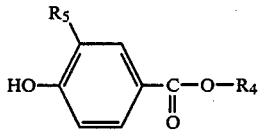

(IIIb)

wherein $R_4$ and $R_5$ each has the same meaning as defined above, in the presence of a base.

The compound represented by the formula (IIIa) and the yellow coupler represented by the formula (I) according to the present invention can be easily synthesized with reference to the methods as described in U.S. Pat. Nos. 3,265,506 and 3,408,194, Japanese Patent Application (OPI) Nos. 99433/79 and 115219/77, etc.

The compounds represented by the formula (IIIb) wherein $R_5$ represents a hydrogen atom are sold commercially and are readily available. On the other hand, those wherein $R_5$ represents a chlorine atom can be synthesized by chlorination with sulfuryl chloride.

Typical examples for synthesis of the couplers according to the present invention are set forth below.

SYNTHESIS EXAMPLE 1

Synthesis of Coupler (1)

To a mixture of 24.0 g of 4-isopropoxycarbonylphenol and 180 ml of acetonitrile was added 20 ml of triethylamine. To the resulting solution was added dropwise a solution containing 65 g of α-chloro-α-pivaloyl-2-chloro-5-(n-hexadecanesulfonamido)acetanilide dissolved in 65 ml of acetonitrile at 30° to 40° C. with stirring. The mixture was reacted at 40° C. for 7 hours and then the reaction mixture was poured into 600 ml of water containing 10 g of sodium hydroxide dissolved therein and extracted with 500 ml of ethyl acetate. The oil layer was washed with water, acidified with diluted hydrochloric acid and then again washed with water. The oil layer was dried with anhydrous magnesium sulfate and concentrated under reduced pressure to obtain 81 g of the residue which was subjected to silica gel chromatography. The part containing the desired compound was concentrated under reduced pressure to obtain 67 g of a residue, which was crystallized with 150 ml of methanol to obtain 38 g of Coupler (1). Melting Point: 69° to 70° C.

SYNTHESIS EXAMPLE 2

Synthesis of Coupler (12)

To a mixture of 18.7 g of 4-isopropoxycarbonylphenol and 200 ml of acetonitrile was added 16 ml of triethylamine. To the resulting solution was added dropwise a solution containing 42.9 g of α-chloro-α-pivaloyl-2-chloro-5-(n-dodecanesulfonamido)acetanilide dissolved in 50 ml of acetonitrile at 30° to 40° C. with stirring. The mixture was reacted at 40° C. for 5 hours and then the reaction mixture was poured into 500 ml of water containing 8 g of sodium hydroxide dissolved therein, and extracted with 500 ml of ethyl acetate. The oil layer was washed with water, acidified with diluted hydrochloric acid, and then again washed with water. The oil layer was dried with anhydrous magnesium sulfate and concentrated under reduced pressure to obtain 56 g of a residue, which was subjected to silica gel chromatography. The part containing the desired compound was concentrated under reduced pressure to obtain 40 g of a residue, which was crystallized with n-hexane to obtain 18 g of Coupler (12). Melting Point: 77° to 79° C.

Other couplers according to the present invention can be prepared in a manner similar to Synthesis Examples 1 and 2 using a corresponding starting material.

Two or more kinds of the yellow couplers according to the present invention can be added to the same layer. The same coupler can be added to two or more different layers.

The yellow couplers according to the present invention may be used in combination with one or more known pivaloylacetanilide type or benzoylacetanilide type yellow couplers.

Representative examples of such yellow couplers include yellow couplers having nitrogen atom-linked coupling-off groups as described in Japanese Patent Publication No. 10739/83, U.S. Pat. Nos. 4,401,752 and 4,326,024, *Research Disclosure,* 18053 (April, 1979), British Patent No. 1,425,020, West German Patent Application (OLS) Nos. 2,219,917, 2,261,361, 2,329,587, 2,433,812, etc., and yellow couplers having oxygen atom-linked coupling-off groups as described in U.S. Pat. Nos. 3,408,194, 3,447,928, 3,933,501, 4,022,620, etc.

In the case of use together with the above-described known couplers, it is preferred that the yellow coupler according to the present invention is employed in a high speed blue-sensitive emulsion layer, and a yellow coupler having nitrogen atom-linked coupling-off groups is employed in a low speed blue-sensitive emulsion layer.

The coupler according to the present invention is generally employed in an amount of from $2\times10^{-3}$ mol to $5\times10^{-1}$ mol, and preferably from $1\times10^{-2}$ mol to $5\times10^{-1}$ mol, per mol of silver in the emulsion layer. In the case of using the coupler according to the present invention in combination with the above-described couplers, it is preferred that the total amount of the couplers which form the same color is in the range described above.

The silver halide color photographic material containing the yellow coupler according to the present invention can be produced according to any method conventionally used by appropriately selecting the silver halide composition, the kind of additive(s), kind of support, etc., depending on the end use thereof, and can be applied to, for example, both color negative films and color reversal films.

The color photographic material according to the present invention can be subjected to development processing according to any method conventionally used.

In the case of dispersing the yellow dye-forming coupler according to the present invention using an oil droplet in water type dispersing method, it is preferred to employ an organic solvent having a high boiling point represented by the formula (VI) or (VII) shown below, a mixture thereof, or a mixture of the organic solvent with an auxiliary solvent (for example, ethyl acetate, etc.).

A ratio by weight of the organic solvent having a high boiling point/the coupler is usually not more than 0.5/1, preferably not more than 0.2/1, and more preferably not more than 0.05/1. A dispersing method using only an auxiliary solvent is also preferred.

Formula (VI) is represented by

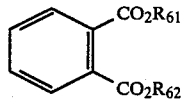

(VI)

wherein $R_{61}$ and $R_{62}$ (which may be the same or different) each represents an alkyl group, a cycloalkyl group, an alkenyl group or an aryl group, and the total number of carbon atoms included in the groups represented by $R_{61}$ and $R_{62}$ is from 4 to 30.

Formula (VII) is represented by

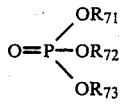

(VII)

wherein $R_7$, $R_{72}$ and $R_{73}$ (which may be the same or different) each represents an alkyl group, a cycloalkyl group, an alkenyl group or an aryl group, and the total number of carbon atoms included in the groups represented by $R_{71}$, $R_{72}$ and $R_{73}$ is from 12 to 60.

The photographic emulsion used in the present invention may be spectrally sensitized with methine dyes or other dyes. Examples of dyes which can be used include cyanine dyes, merocyanine dyes, complex cyanine dyes, complex merocyanine dyes, holopolar cyanine dyes, hemicyanine dyes, styryl dyes and hemioxonol dyes, and particularly useful dyes are cyanine dyes, merocyanine dyes, and complex merocyanine dyes. In these dyes, it is possible to have any nucleus conventionally used for cyanine dyes as the basic heterocyclic nucleus. Specifically, it is possible to have a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-described nuclei to which an alicyclic hydrocarbon ring is fused; and the above-described nuclei to which an aromatic hydrocarbon ring is fused, namely, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may have substituents on the carbon atoms thereof.

In merocyanine dyes and complex merocyanine dyes, 5-membered or 6-membered heterocyclic nuclei such as a pyrazoline-5-one nucleus, a thiohydantoin nucleus, a 2-thioxazolidine-2,4-dione nucleus, a thiazoline-2,4-dione nucleus, a rhodanine nucleus, or a thiobarbituric acid nucleus, etc., may be present as nuclei having a ketomethylene structure.

These sensitizing dyes may be used alone, or combinations thereof can be used. Combinations of sensitizing dyes are used frequently for the purpose of, particularly, supersensitization.

The emulsion may contain dyes which do not have a spectral sensitization function themselves but exhibit supersensitization together with the sensitizing dyes or substances which do not substantially absorb visible light but exhibit supersensitization together with the senitizing dyes.

The sensitizing dye used in a blue-sensitive emulsion layer is preferably selected from merocyanine dyes or cyanine dyes represented by the formula (VIII-1), (VIII-2), (IX) or (X) described below. Two or more kinds of these sensitizing dyes may be used in combination.

Formulae (VIII-1) and (VIII-2) are represented by (VIII-1)

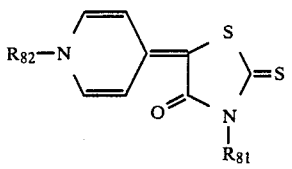

and (VIII-2)

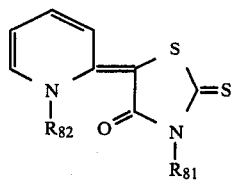

wherein $R_{81}$ represents an unsubstituted or substituted alkyl group, an unsubstituted or substituted aryl group, an unsubstituted or substituted aralkyl group, an unsubstituted or substituted alkenyl group or an allyl group; and $R_{82}$ represents an unsubstituted or substituted alkyl group, an unsubstituted or substituted alkenyl group or an allyl group.

(IX)

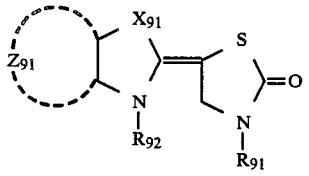

wherein $R_{91}$ has the same meaning as defined for $R_{81}$ in the formula (VIII-1); $R_{92}$ has the same meaning as defined for $R_{82}$ in the formula (VIII-1); $X_{91}$ represents an oxygen atom or a sulfur atom; and $Z_{91}$ represents an atomic group forming a benzene ring or a naphthalene ring.

(X)

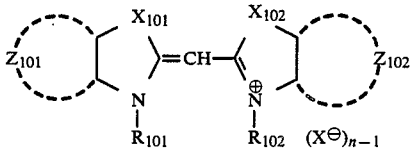

wherein $X_{101}$ and $X_{102}$ each represents an oxygen atom or sulfur atom; $R_{101}$ and $R_{102}$ each has the same meaning as defined for $R_{82}$ in the formula (VIII-1); $Z_{101}$ and $Z_{102}$ each has the same meaning as defined for $Z_{91}$ in the formula (IX); $X^{\ominus}$ represents an anion; and n represents 1 or 2.

In the formulae (VIII-1), (VIII-2), (IX) and (X) described above, suitable examples of substituents for the substituted alkyl group represented by $R_{81}$, $R_{82}$, $R_{91}$, $R_{92}$, $R_{101}$ or $R_{102}$ include a sulfo group, a carboxy group, an alkoxycarbonyl group, an alkoxy group, a hydroxy group, an acylamino group, a sulfonamido group, a sulfamoyl group, a carbamoyl group, etc.

Suitable examples of substituents for the substituted aryl group represented by $R_{81}$ or $R_{91}$ include a halogen atom, a cyano group, an amino group, an alkyl group, etc., in addition to the substituents defined for the substituted alkyl group described above.

The benzene ring (or naphthalene ring) represented by $Z_{91}$, $Z_{101}$ and $Z_{102}$ may be substituted with one or more substituents selected from those defined for the substituted alkyl group or the substituted aryl group.

Specific examples of the sensitizing dyes represented by the formulae (VIII-1), (VIII-2), (IX) and (X) are set forth below, but the present invention is not to be construed as being limited thereto.

Formula (VIII-1)

| No. | $R_{81}$ | $R_{82}$ |
|---|---|---|
| VIII-1-1 | $-C_2H_5$ | $-(CH_2)_4SO_3Na$ |
| -2 | $-CH_2-CH=CH_2$ | $-(CH_2)_4SO_3Na$ |
| -3 | $-CH_2CO_2H$ | $-(CH_2)_4SO_3Na$ |
| -4 | 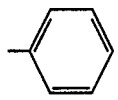 | $-(CH_2)_4SO_3Na$ |
| -5 | $-CH_2CH_2OH$ | $-(CH_2)_4SO_3Na$ |
| -6 | $-(CH_2)_2OCH_3$ | $-(CH_2)_3SO_3Na$ |
| -7 | 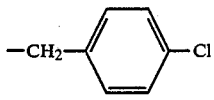 | $-(CH_2)_3SO_3Na$ |

Formula (VIII-2)

| No. | $R_{81}$ | $R_{82}$ |
|---|---|---|
| VIII-2-1 | $-C_2H_5$ | $-(CH_2)_4SO_3Na$ |
| -2 | $-CH_2-CH=CH_2$ | $-(CH_2)_4SO_3Na$ |
| -3 | 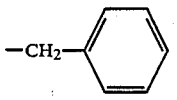 | $-(CH_2)_4SO_3Na$ |
| -4 | $-CH_2CH_2OH$ | $-(CH_2)_2NHSO_2CH_3$ |
| -5 | $-CH_2CO_2H$ | $-(CH_2)_3SO_3K$ |

Formula (IX)
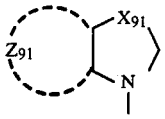
| No. | $R_{92}$ | $R_{91}$ |
|---|---|---|
| IX-1 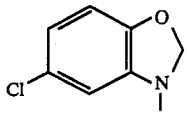 | $-(CH_2)_3SO_3Na$ | $-C_2H_5$ |
| -2 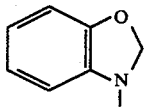 | $-(CH_2)_3SO_3HN(C_2H_5)_3$ | $-CH_2-$ 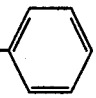 |
| -3 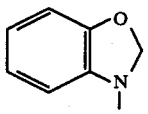 | $-(CH_2)_3SO_3HN(C_2H_5)_3$ | $-CH_2CH_2OH$ |
| -4 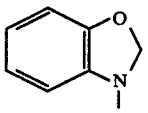 | $-(CH_2)_3SO_3HN(C_2H_5)_3$ | $-CH_2CO_2H$ |
| -5 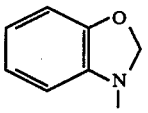 | $-(CH_2)_3SO_3HN(C_2H_5)_3$ | $-CH_2CH_2CH_3$ |
| -6 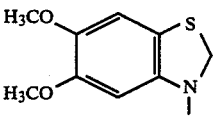 | $-(CH_2)_3SO_3Na$ | $-CH_2CH_2OH$ |
| -7 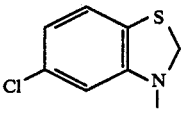 | $-(CH_2)_3SO_3Na$ | $-CH_2-$ 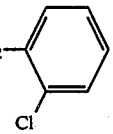 |
| -8 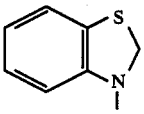 | $+(CH_2)_4SO_3Na$ | $-CH_2-$ 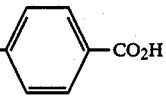 |
| -9 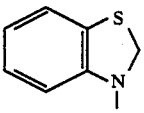 | $-(CH_2)_2SO_3Na$ | $-CH_2CO_2H$ |
| -10 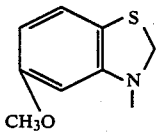 | $-(CH_2)_4SO_3HN(C_2H_5)_3$ | $-CH_2CH_2OH$ |

-continued
Formula (IX)
| No. | $Z_{91}$ 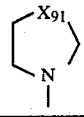 | $R_{92}$ | $R_{91}$ |
|---|---|---|---|
| -11 | 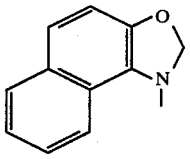 | $-(CH_2)_3SO_3Na$ | $-CH_2-$ 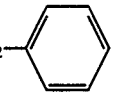 |
| -12 | 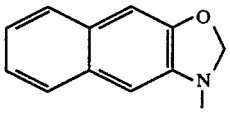 | $-(CH_2)_3SO_3Na$ | $-CH_2-$ 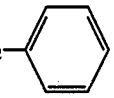 |
Formula (X)
| No. | 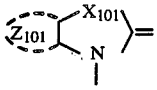 | $R_{101}$ | 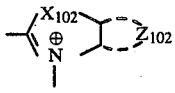 | $R_{102}$ | $X^{\ominus}$ |
|---|---|---|---|---|---|
| X-1 | 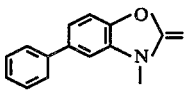 | $-(CH_2)_4SO_3^{\ominus}$ | 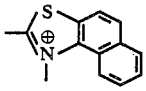 | $-(CH_2)_3SO_3HN(C_2H_5)_3$ | None |
| -2 | 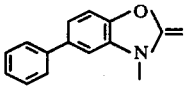 | $-(CH_2)_4SO_3^{\ominus}$ | 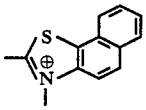 | $-(CH_2)_3SO_3HN(C_2H_5)_3$ | None |
| -3 | 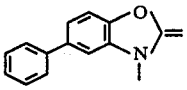 | $-(CH_2)_3SO_3^{\ominus}$ | 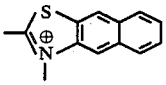 | $-(CH_2)_3SO_3HN(C_2H_5)_3$ | None |
| -4 | 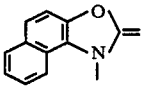 | $-(CH_2)_3SO_3^{\ominus}$ | 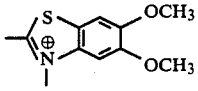 | $-(CH_2)_3SO_3HN(C_2H_5)_3$ | None |
| X-5 | 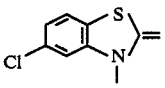 | $-(CH_2)_4SO_3^{\ominus}$ | 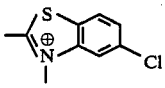 | $-(CH_2)_4SO_3HN(C_2H_5)_3$ | None |
| -6 | 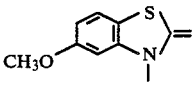 | $-(CH_2)_3SO_3^{\ominus}$ | 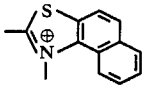 | $-(CH_2)_3SO_3HN(C_2H_5)_3$ | None |
| -7 | 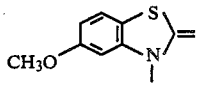 | $-(CH_2)_3SO_3^{\ominus}$ | 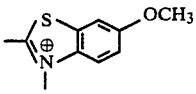 | $-(CH_2)_2SO_3Na$ | None |

-continued

Formula (X)

| No. | 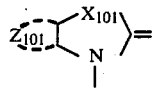 | $R_{101}$ | 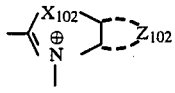 | $R_{102}$ | $X^{\ominus}$ |
|---|---|---|---|---|---|
| -8 | 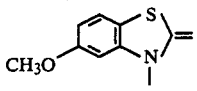 | $-C_2H_5$ | 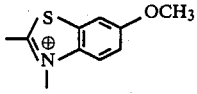 | $-C_2H_5$ | 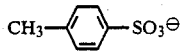 |
| -9 | 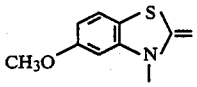 | $-CH_2CH_2OH$ | 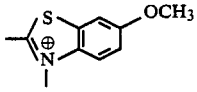 | $-C_2H_5$ | $Br^{\ominus}$ |
| -10 | 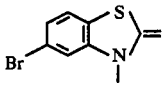 | $-(CH_2)_4SO_3^{\ominus}$ | 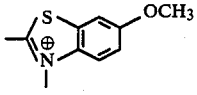 | $-(CH_2)_3SO_3NH(C_2H_5)_3$ | None |
| -11 | 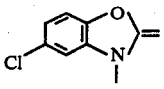 | $-(CH_2)_4SO_3^{\ominus}$ | 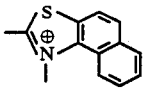 | $-(CH_2)_3SO_3HN(C_2H_5)_3$ | None |
| -12 | 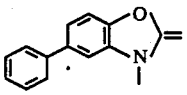 | $-(CH_2)_4SO_3^{\ominus}$ | 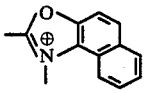 | $-(CH_2)_3SO_3HN(C_2H_5)_3$ | None |

Examples of magenta couplers that can be used in the present invention include oil protected type indazolone-series couplers, or cyanoacetyl-series couplers, and preferably 5-pyrazolone-series couplers and pyrazoloazole-series couplers such as pyrazolotriazoles, and polymerized magenta couplers. Of these magenta couplers, polymerized 5-pyrazolone-series magenta couplers, pyrazoloazole-series magenta couplers and polymerized pyrazoloazole-series magenta couplers are particularly preferred.

Specific examples of polymerized 5-pyrazolone-series magenta couplers are described in U.S. Pat. Nos. 4,409,320, 4,436,808, 4,474,870 and 4,444,870, Japanese Patent Application (OPI) Nos. 23856/85, 224352/83, 94752/82, etc.

Specific examples of pyrazolotriazole-series magenta couplers include pyrazolobenzimidazoles as described in U.S. Pat. No. 3,369,879, etc., and preferably pyrazolo[5,1-c][1,2,4]triazoles described in U.S. Pat. No. 3,725,067; pyrazolotetrazoles as described in *Research Disclosure,* RD No. 24220 (June, 1984), and pyrazolopyrazoles as described in *Research Disclosure,* RD No. 24230 (June, 1984), etc. From the viewpoint of showing less yellow subsidiary absorption of the dye formed therefrom and of high light fastness thereof, imidazo-[ 1,2-b]pyrazoles as described in European Patent No. 119,741 are preferred, and pyrazolo[1,5-b][1,2,4]triazoles as described in European Patent No. 119,860 are particularly preferred.

Specific examples of polymerized pyrazoloazole-series magenta couplers are described in Japanese Patent Application (OPI) Nos. 228252/84, 35732/85, etc.

Examples of cyan couplers that can be used in the present invention include oil protected type naphthol-series and phenol-series couplers. Typical examples thereof include naphthol-series couplers as described in U.S. Pat. No. 2,474,293, etc., and preferably 2-equivalent naphthol-series couplers having oxygen atom-linked coupling-off groups as described in U.S. Pat. Nos. 4,052,212, 4,146,396, 4,228,233, 4,296,200, etc. Also, specific examples of phenol-series couplers are described in U.S. Pat. Nos. 2,369,929, 2,801,171, 2,772,162, 2,895,826, etc.

Cyan couplers having high fastness to humidity and temperature are preferably used in the present invention and typical examples thereof include phenol-series cyan couplers having an alkyl group not less than ethyl group at the meta-position of the phenol nucleus thereof as described in U.S. Pat. No. 3,772,002; 2,5-diacylaminosubstituted phenol-series couplers as described in U.S. Pat. Nos. 2,772,162, 3,758,308, 4,126,396, 4,334,011 and 4,327,173, West German Patent Application (OLS) No. 3,329,729, Japanese Patent Application No. 42671/83 (corresponding to Japanese Patent Application (OPI) No. 166956/84), etc.; and phenol-series couplers having a phenylureido group at the 2-position of the phenol nucleus and an acylamino group at the 5-position thereof, as described in U.S. Pat. Nos. 3,446,622, 4,333,999, 4,451,559, 4,427,767, etc.

In particular, phenol-series cyan couplers having an acylamino group substituted with a fluorine atom at the 2-position of the phenol nucleus and an unsubstituted acylamino group having from 8 to 30 carbon atoms or an acylamino group substituted with a phenoxy group having from 6 to 28 carbon atoms at the 5-position thereof are preferred.

A standard amount of color coupler is used, typically in a range of from 0.001 mol to 1 mol per mol of a light-sensitive silver halide. It is preferred to use a range from 0.01 mol to 0.5 mol of a yellow coupler, a range from 0.003 mol to 0.3 mol of a magenta coupler, and a range from 0.002 mol to 0.3 mol of a cyan coupler, per mol of a light-sensitive silver halide.

A standard coating amount of color coupler in color paper is typically in a range from $4\times10^{-4}$ mol/m$^2$ to $14\times10^{-4}$ mol/m$^2$ with a yellow coupler, in a range from $2\times10^{-4}$ mol/m$^2$ to $8\times10^{-4}$ mol/m$^2$ with a magenta coupler, and in a range from $2\times10^{-4}$ mol/m$^2$ to $9\times10^{-4}$ mol/m$^2$ with a cyan coupler.

The silver halide emulsion which is used in the emulsion layer of the silver halide color photographic material of the present invention is usually prepared by mixing an aqueous solution of a water-soluble silver salt (for example, silver nitrate) with an aqueous solution of a water-soluble halogen salt (for example, potassium bromide, sodium chloride, potassium iodide or a mixture thereof) in the presence of an aqueous solution of a water-soluble polymer (for example, gelatin, etc.).

Representative examples of silver halide thus prepared include mixed silver halide, for example, silver chlorobromide, silver chloroiodobromide, silver iodobromide, etc., as well as silver chloride and silver bromide. Silver halide preferably employed in the present invention is silver chloroiodobromide, silver iodochloride or silver iodobromide each of which contains no silver iodide or not more than 3 mol % of silver iodide.

Silver halide grains may have different layers in the inner portion and the surface portion, multiphase structures containing junctions or may be uniform throughout the grains. Further, a mixture of these silver halide grains having different structures may be employed. For instance, with respect to silver chlorobromide grains having different phases, those having nuclei which are rich in silver bromide as compared with the mean halogen composition or a single layer or plural layers, or those having nuclei which are rich in silver chloride as compared with the mean halogen composition or a single layer or plural layers are exemplified. On the contrary, nuclei may be covered with a surface layer which is rich in silver bromide or silver chloride as compared with the mean halogen composition.

Average grain size of silver halide grains (the term grain size as used herein refers to a grain diameter in the case of grains spherical or approximately spherical in shape, while it refers to the edge length in the case of cubic grains; in other cases it refers to the diameter of a circle having an area equal to the projected area of the grains) is preferably from 0.1 μm to 2 μm, and particularly preferably is from 0.15 μm to 1 μm.

Grain size distribution may be either narrow or broad.

A so-called monodispersed silver halide emulsion having a narrow grain size distribution can be employed in the present invention. The monodispersed silver halide emulsion is a silver halide emulsion in which at least 90%, particularly at least 95% by weight or by number of the total silver halide grains have a size within the range of the average grain size ±40%.

Furhter, in order to achieve the desired gradation of the light-sensitive material, two or more monodispersed silver halide emulsions which have different grain sizes from each other can be mixed in one emulsion layer or can be coated in the form of superimposed layers which have substantially the same color sensitivity. Moreover, two or more polydispersed silver halide emulsions or combinations of a monodispersed emulsion and a polydispersed emulsion may be employed in a mixture or in the form of superimposed layers.

Silver halide grains which can be used in the present invention may have a regular crystal structure, for example, a cubic, octahedral, dodecahedral or tetradecahedral structure, etc., an irregular crystal structure, for example, a spherical structure, etc., or a. composite structure thereof.

Further, tabular silver halide grains can be used. Tabular silver halide emulsions wherein silver halide grains having a thickness of less than 0.5 μm , a diameter of not less than 0.6 μm and an average aspect ratio of not less than 5 occupy at least 50% of the total projected area of the silver halide grains present are preferably utilized. The term "aspect ratio" used herein refers to the ratio of diameter/thickness of the grain. The diameter of such a grain refers to the diameter of a circle which has an area equal to the projected area of the grain and the thickness of grain means a distance between two parallel planes forming the tabular silver halide grains.

The halogen composition of the tabular silver halide grains may be any of silver bromide, silver iodide, silver iodobromide, silver chlorobromide, silver chloroiodobromide and silver chloride, but silver bromide and silver iodobromide are preferred. Silver iodobromide having a silver iodide content of up to 30 mol % is particularly preferred.

In addition, mixtures of silver halide grains having different crystal structures may be used. These silver halide emulsions may be those of surface latent image type in which latent images are formed mainly on the surface thereof, those of internal latent image type in which latent images are formed mainly in the interior thereof.

Photographic emulsions as used in the present invention can be prepared in any suitable manner, for example, by the methods as described in P. Glafkides, *Chimie et Physique Photographique,* pp. 329–425, Paul Montel (1967); G. F. Duffin, *Photographic Emulsion Chemistry,* pp. 57–82, The Focal Press (1966); and V. L. Zelikman et al., Making and Coating Photographic Emulsion, pp. 69–87, The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide grains are formed in the presence of an excess of silver ions. As one system of the double jet process, a so-called controlled double jet process in which the pAg in a liquid phase where silver halide is formed is maintained at a predetermined level can be employed. This process can prepare a silver halide emulsion in which the crystal form is regular and the particle size is nearly uniform.

During the step of formation or physical ripening of silver halide grains, cadmium salts, zinc salts, lead salts, thallium salts, iridium salts or the complex salts thereof, rhodium salts or the complex salts thereof, iron salts or the complex salts thereof, etc., may be present.

The preparation of the tabular silver halide grains can be carried out by suitably combining processes known in this field of the art, for example, processes as described in E. B. Gutoff, *Photographic Science and Engineering,* 14, pp. 248–257 (1970), U.S. Pat. Nos. 4,414,310, 4,433,048, 4,434,226 and 4,439,520.

For example, they can be obtained by a process which comprises forming seed crystals wherein tabular grains are present in an amount of 40% by weight or more in a solution having a comparatively low pBr of 1.3 or less, and growing the seed crystals by simultaneously adding silver and halogen solutions while keeping the pBr at the above-descrived value.

In the step of growing grains, it is desired to add the silver and halogen solutions at rates so as to minimize the formation of fresh crystal nuclei.

The size of tabular silver halide grains can be adjusted by controlling temperature, selecting the kind and the amount of the solvent, controlling the addition rate of the silver salt and the halide employed at the step of growing grains, and the like.

In the preparation of the tabular silver halide grains used in the present invention, it is possible to control the particle size, shape of grains (ratio of diameter/thickness, etc.), distribution of particle size and growth rate of grains by using, if desired, a silver halide solvent as described hereinafter. The amount of the solvent used is preferred to be in a range of from about $10^{-3}$ to 1.0% by weight, and particularly preferably is $10^{-2}$ to $10^{-1}$% by weight, based on the total weight of the reaction solution.

For example, as the amount of the solvent to be used is increased, the distribution of particle size becomes uniform, i.e., "monodispersed" and the growth rate can be increased. On the other hand, the thickness of grains tends to increase with an increase in the amount of the solvent used.

The silver halide solvent is added during the preparation of the tabular silver halide grains in order to increase the rate of growth of grains. Methods involving increasing the rate of addition, the amount of addition and the concentration of a silver salt solution (for example, an aqueous solution of silver nitrate) and a halide solution (for example, an aqueous solution of potassium bromide) are preferably used.

Such methods are described in British Patent No. 1,335,925, U.S. Pat. Nos. 3,672,900, 3,650,757 and 4,242,445, and Japanese Patent Application (OPI) Nos. 142329/80, 158124/80, 113927/83, 113928/83, 111934/83, 111936/83, etc.

After the formation of silver halide grains, silver halide emulsions are usually subjected to physical ripening, removal of soluble salts and chemical ripening, and are then employed for coating.

Monodispersed emulsions having regular crystal form and nearly uniform particle size distribution can be obtained by conducting physical ripening of silver halide emulsions in the presence of known silver halide solvents (for example, ammonia, potassium thiocyanate, and thioethers and thione compounds as described in U.S. Pat. No. 3,271,157, Japanese Patent Application (OPI) Nos. 12360/76, 82408/78, 144319/78, 100717/79, 155828/79, etc.).

For removal of soluble silver salts from the emulsion after physical ripening, a noodle washing process, a flocculation process or an ultrafiltration process, etc., can be employed.

The silver halide emulsion which can be used in the present invention can be subjected to chemical sensitization using sulfur or selenium sensitization, reduction sensitization, noble metal sensitization, individually or in combination with each other. More specifically, a sulfur sensitization method using active gelatin or compounds containing sulfur capable of reacting with silver (for example, thiosulfates, thioureas, mercapto compounds and rhodanines, etc.), a reduction sensitization method using reducing substances (for example, stannous salts, amines, hydrazine derivatives, formamidinesulfinic acid, silane compounds, etc.), a noble metal sensitization method using metal compounds (for example, complex salts of Group VIII metals in the Periodic Table, such as Pt, Ir, Pd, Rh, Fe, etc., as well as gold complex salts); and so forth can be employed individually or in combination with each other.

For purposes of preventing fog or stabilizing the photographic properties during production, storage, and/or photographic processing of the photographic lightsensitive material, a variety of compounds can be incorporated into the photographic emulsion used in the present invention. For example, a wide variety of compounds which are known as antifogging agents or stabilizers, such as azoles, e.g., benzothiazolium salts, benzimidazolium salts, imidazoles, benzimidazoles (preferably, 5-nitrobenzimidazoles), nitroindazoles, benzotriazoles (preferably, 5-methylbenzotriazoles), triazoles, etc.; mercapto compounds, e.g., mercaptothiazoles, mercaptobenzothiazoles, mercaptobenzimidazoles, mercaptobenzoxazoles, mercaptoxadiazoles, mercaptotriazoles, mercaptotetrazoles (especially, 1-phenyl-5-mercaptotetrazole, etc.), mercaptopyrimidines, mercaptotriazines, etc.; thiocarbonyl compounds, such as oxazolinethione, etc.; azaindenes, e.g., triazaindenes, tetraazaindenes (especially, 4-hydroxy-6-methyl-1,3,3a,7-tetraazaindene, etc.), pentaazaindenes, etc.; benzenethiosulfonic acids, benzenesulfinic acids, benzenesulfonic acid amides; purines such as adenine, etc., may be employed.

Specific examples of antifogging agents and stabilizers and method of using thereof are described, for example, in U.S. Pat. Nos. 3,954,474 and 3,982,947, Japanese Patent Publication No. 28660/77, *Research Disclosure*, No. 17643, VIA to VIM (December, 1978), E. J. Birr, *Stabilization of Photographic Silver Halide Emulsions, The Focal Press* (1974), etc.

The photographic light-sensitive material according to the present invention may contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

In the color photographic light-sensitive material used in the present invention, various color fading preventing agents can be employed. Typical examples of organic color fading preventing agents include hydroquinones, 6-hydroxychromans, 5-hydroxycoumarans, spirochromans, p-alkoxyphenols, hindered phenols, for example, bisphenols, etc., gallic acid derivatives, methylenedioxybenzenes, aminophenols, hindered amines, or ether or ester derivatives thereof derived from each of these compounds by silylation or alkylation of the phenolic hydroxy group thereof. Further, metal complexes represented by (bissalicylaldoximato)nickel complexes and (bis-N,N-dialkyldithiocarbamato)nickel complexes may be employed.

Specific examples of useful organic color fading preventing agents include hydroquinones as described in U.S. Pat. Nos. 2,360,290, 2,418,613, 2,700,453, 2,701,197, 2,728,659, 2,732,300, 2,735,765, 3,982,944 and 4,430,425, British Patent No. 1,363,921, U.S. Pat. Nos. 2,710,801, 2,816,028, etc.; 6-hydroxychromans, 5-hydroxycoumarans and spirochromans as described in U.S. Pat. No. 3,432,300, 3,573,050, 3,574,627, 3,698,909 and 3,764,337, Japanese Patent Application (OPI) No. 152225/77, etc.; spiroindanes as described in U.S. Pat.

No. 4,360,589, etc.; p-alkoxyphenols as described in U.S. Pat. No. 2,735,765, British Patent No. 2,066,975, Japanese Patent Application (OPI) No. 10539/84, Japanese Patent Publication No. 19764/82, etc.; hindered phenols as described in U.S. Pat. No. 3,700,455, Japanese Patent Application (OPI) No. 72225/77, U.S. Pat. No. 4,228,235, Japanese Patent Publication No. 6623/77, etc.; gallic acid derivatives, methylenedioxybenzenes and aminophenols as described in U.S. Pat. Nos. 3,457,079 and 4,332,886, Japanese Patent Publication No. 21144/81, etc.; hindered amines as described in U.S. Pat. Nos. 3,336,135 and 4,268,593, Bristish Patent Nos. 1,326,889, 1,354,313 and 1,410,846, Japanese Patent Publication No. 1420/76, Japanese Patent Application (OPI) Nos. 114036/83, 53846/84, 78344/84, etc.; ether or ester derivatives of phenolic hydroxy group as described in U.S. Pat. Nos. 4,155,765, 4,174,220, 4,254,216 and 4,264,720, Japanese Patent Application. (OPI) Nos. 145530/79, 6321/80, 105147/83 and 10539/84, Japanese Patent Publication No. 37856/82, U.S. Pat. No. 4,279,990, Japanese Patent Publication No. 3263/78, etc.; and metal complexes as described in U.S. Pat. Nos. 4,050,938 and 4,241,155, British Patent No. 2,027,731A, etc.

For the purpose of preventing degradation of yellow dye images due to heat, humidity and light, compounds having both a hindered amine moiety structure and a hindered phenol moiety structure in their molecules as described in U.S. Pat. No. 4,268,593, etc., provide a good result. Further, in order to prevent degradation of magenta dye images, particularly degradation due to light, spiroindanes as described in Japanese Patent Application (OPI) No. 159644/81, etc., and chromans substituted with a hydroquinone diether or monoether as described in Japanese Patent Application (OPI) No. 89835/80, etc., provide a preferred result. These compounds can be incorporated into a light-sensitive layer by emulsification together with corresponding color couplers in a general amount of from 5 to 100% by weight of the couplers in order to achieve the objects. On the other hand, introduction of ultraviolet ray absorbent into both of two layers adjacent to a cyan color forming layer is effective for the purpose of preventing degradation of cyan dye image due to heat and particularly light.

The photographic light-sensitive material according to the present invention may contain an ultraviolet ray absorbent in a hydrophilic colloid layer thereof. Examples of the ultraviolet ray absorbents used are benzotriazole compounds substituted with an aryl group as described in U.S. Pat. Nos. 3,553,794 and 4,236,013, Japanese Patent Publication No. 6540/76, European Patent No. 57,160, etc., butadiene compounds as described in U.S. Pat. Nos. 4,450,229, 4,195,999, etc., cinnamic acid ester compounds as described in U.S. Pat. Nos. 3,705,805, 3,707,375, etc., benzophenone compounds as described in U.S. Pat. No. 3,215,530, British Patent No. 1,321,355, etc., and polymer compounds having ultraviolet ray absorbing residues as described in U.S. Pat. Nos. 3,761,272, 4,431,726, etc.

Further, brightening agents having ultraviolet ray absorbing function as described in U.S. Pat. Nos. 3,499,762, 3,700,455, etc., may be used. Typical examples of the ultraviolet ray absorbents are also described in *Research Disclosure,* No. 24239 (June, 1984), etc.

The photographic light-sensitive material used in the present invention may contain water-soluble dyes as filter dyes or for irradiation or halation prevention or other various purposes in a hydrophilic colloid layer thereof. These dyes preferably used include oxonol dyes, hemioxonol dyes, styryl dyes, merocyanine dyes, anthraquinone dyes, and azo dyes. In addition, cyanine dyes, azomethine dyes, triarylmethane dyes, and phthalocyanine dyes are also useful. It is also possible that oil-soluble dyes are emulsified by an oil droplet in water type dispersing method, and the dispersion is then added to a hydrophilic colloid layer.

The photographic light-sensitive material used in the present invention may contain a whitening agent of the stilbene-series, triazine-series, oxazole-series or coumarine-series, etc., in a photographic emulsion layer or other hydrophilic colloid layers. Water-soluble whitening agents may be employed. Also, water-insoluble whitening agents may be used in the form of a dispersion.

As a binder or a protective colloid which can be used in the photographic emulsion layer or an intermediate layer of the photographic light-sensitive material according to the present invention, gelatin is advantageously used, but other hydrophilic colloids may also be employed.

For example, it is possible to use proteins such as gelatin derivatives, graft polymers of gelatin and other polymers, albumin, casein, etc., saccharides such as cellulose derivatives such as hydroxyethyl cellulose, carboxymethyl cellulose, cellulose sulfate, etc., sodium alginate, starch derivatives, etc., and various synthetic hydrophilic high molecular substances such as homopolymers or copolymers, for example, polyvinyl alcohol, polyvinyl alcohol semiacetal, poly-N-vinylpyrrolidone, polyacrylic acid, polymethacrylic acid, polyacrylamide, polyvinylimidazole, polyvinylpyrazole, etc.

As gelatin, not only lime-processed gelatin conventionally used, but also acid-processed gelatin and enzyme-processed gelatin as described in *Bull. Soc. Sci. Phot. Japan,* No. 16, page 30 (1966) may be used. Further, hydrolyzed product of gelatin or enzymatically decomposed product of gelatin may also be used.

The photographic light-sensitive material according to the present invention may contain an inorganic or organic hardener in the photographic light-sensitive layer or other hydrophilic colloid layers thereof, including a back layer.

The photographic light-sensitive material according to the present invention may contain one or more kinds of surface active agents for various purposes such as improvement of coating properties, antistatic properties, slipping properties, emulsion dispersibility, antiadhesion properties, and photographic properties (for example, development acceleration, increase in contrast, sensitization, etc.).

Moreover, into the photographic light-sensitive material according to the present invention can be incorporated various kinds of stabilizers, contamination preventing agents, developing agents or the precursors thereof, development accelerating agents or the precursor thereof, lubricants, mordants, matting agents, antistatic agents, plasticizers or other additives useful for photographic light-sensitive materials in addition to the above-described additives. Typical examples of these additives are described in *Research Disclosure,* No. 17643 (December, 1978) and *Research Disclosure,* No. 18716 (November, 1979).

The present invention is also applicable to a multilayer multicolor photographic material containing at least two layers which are sensitive to different spectral wavelength ranges on a support. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of the disposition of these light-sensitive layers can be varied and appropriately determined depending on the intended purpose. A preferred disposition is that a red-sensitive layer, a green-sensitive layer and a blue-sensitive layer are arranged in the order listed from the support side, or that a blue-sensitive layer, a red-sensitive layer and a green-sensitive layer are arranged in the order listed from the support side. Further, each of the above-described emulsion layers may be composed of two or more emulsion layers having different sensitivities. Moreover, between two or more emulsion layers having the same color sensitivity, a light-insensitive layer may be present.

Typically, the red-sensitive silver halide emulsion layer contains a cyan-forming coupler, the green-sensitive silver halide emulsion layer contains a magenta-forming coupler, and the blue-sensitive silver halide emulsion layer contains a yellow-forming coupler, but different combinations may be employed, if desired.

It is preferred that in the photographic light-sensitive material according to the present invention, an auxiliary layer, for example, a protective layer, an intermediate layer, a filter layer, an antihalation layer, a back layer, etc., is appropriately provided in addition to the silver halide emulsion layer.

In the photographic light-sensitive material of the present invention, photographic emulsion layers and other layers are coated on a flexible support such as a plastic film, paper, cloth, etc., or on a rigid support such as glass, ceramic, metal, etc., conventionally used for photographic light-sensitive materials. Examples of useful flexible support which can be used include films composed of semisynthetic or synthetic polymers such as cellulose nitrate, cellulose acetate, cellulose acetate butyrate, polystyrene, polyvinyl chloride, polyethylene terephthalate, polycarbonate, etc.; and paper coated or laminated with a baryta layer or an $\alpha$-olefin polymer (e.g., polyethylene, polypropylene, an ethylene-butane copolymer, etc.).

Supports may be colored with dyes or pigments. Further, they may be rendered black for the purpose of light shielding. The surfaces of these supports are, in general, subjected to a subbing treatment to increase adhesiveness to photographic emulsion layers. Before or after receiving the subbing treatment, the surfaces of the support may be subjected to a glow discharge treatment, a corona discharge treatment, an ultraviolet ray irradiation treatment, a flame treatment, etc.

In the present invention, photographic emulsion layers and other hydrophilic colloid layers can be coated on a support or other layers using various conventional coating methods. Examples of such coating methods include a dip coating method, a roller coating method, a curtain coating method, an extrusion coating method, etc. By the coating methods as described in U.S. Pat. Nos. 2,681,294, 2,761,791, 3,526,528, 3,508,947, etc., multilayers are coated at the same time, if desired.

The present invention can be applied to various color photographic light-sensitive materials. Representative examples include color negative films for general use or movies, color reversal films for slides or television, color paper, color positive films, color reversal paper, etc. The present invention can also be applied to black-and-white photographic light-sensitive materials utilizing a mixture of three color couplers as described in *Research Disclosure,* RD No. 17123 (July, 1978), etc.

A color developing solution which can be used in development processing of the color photographic light-sensitive material according to the present invention is preferably an alkaline aqueous solution containing an aromatic primary amine-type color developing agent as a main component. As the color developing agent, while an aminophenol-type compound is useful, a p-phenylenediamine-type compound is preferably employed. Typical examples of the p-phenylenediamine-type compounds include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, hydrochloride or p-toluenesulfonate thereof, etc. These diamines are preferably employed in the form of salts since the salts are generally more stable than their free forms.

The color developing solution can usually contain pH buffering agents, such as carbonates, borates or phosphates of alkali metals, etc.; and development inhibitors or antifogging agents such as bromides, iodides, benzimidazoles, benzothiazoles or mercapto compounds, etc. Further, if necessary, the color developing solution may contain preservatives such as hydroxylamine, sulfites, etc.; organic solvents such as triethanolamine, diethylene glycol, etc.; development accelerators such as benzyl alcohol, polyethylene glycol, quaternary ammonium salts, amines, etc.; dye-forming couplers; competing couplers; nucleating agents such as sodium boronhydride, etc.; auxiliary developing agents such as 1-phenyl-3-pyrazolidone, etc.; viscosity imparting agents; and various chelating agents as represented by aminopolycarboxylic acids, aminopolyphosphonic acids, alkylphosphonic acids and phosphonocarboxylic acids, etc.; and antioxidants as described in West German Patent Application (OLS) No. 2,622,950; etc.

In the case of development processing fo reversal color photographic light-sensitive materials, color development is usually conducted after black-and-white development. In a black-and-white developing solution, known black-and-white developing agents, for example, dihydroxybenzenes such as hydroquinone, etc., 3-pyrazolidones such as 1-phenyl-3-pyrazolidone, etc., or aminophenols such as N-methyl-p-aminophenol, etc., may be employed individually or in combination.

After color development, the photographic emulsion layer is usually subjected to a bleach processing. The bleach processing can be carried out simultaneously with or separately from a fix processing.

Examples of bleaching agents which can be employed include compounds of a multivalent metal such as iron (III), cobalt (III), chromium (VI), copper (II), etc.; peracids; quinones; nitroso compounds, etc. Representative examples of the bleaching agents include ferricyanides; dichloromates; organic complex salts of iron (III) or cobalt (III) (for example, complex salts of aminopolycarboxylic acids such as ethylenediaminetetraacetic acid, diethylenetriaminepentaacetic acid, nitrilotriacetic acid, 1,3-diamino-2-propanoltetraacetic acid, etc., or complex salts of organic acids such as citric acid, tartaric acid, malic acid, etc.); persulfates; manganates; nitrosophenol; etc. Of these compounds, iron (III) salts of ethylenediaminetetraacetic acid and persulfates are preferred in view of rapid processing and less environmental pollution. Further, ethylenediaminetetraacetic acid iron (III) complex salts are particularly useful both in an independent bleaching solution and in a monobath bleach-fixing solution.

In a bleaching solution or a bleach-fixing solution, various kinds of accelerating agents can be used, if desired. For example, in addition to bromine ions and iodine ions, thiourea-series compounds as described in U.S. Pat. No. 3,706,561, Japanese Patent Publication Nos. 8506/70 and 26586/74, Japanese Patent Application (OPI) Nos. 32735/78, 36233/78, 37016/78, etc.; thiol-series compounds as described in Japanese Patent Application (OPI) Nos. 124424/78, 95631/78, 57831/78, 32736/78, 65732/78 and 52534/79, U.S. Pat. No. 3,893,858, etc.; heterocyclic compounds as described in Japanese Patent Application (OPI) Nos. 59644/74, 140129/75, 28426/78, 141623/78, 104232/78, 35727/79, etc.; thicetherseries compounds as described in Japanese Patent Application (OPI) Nos. 20832/77, 25064/80, 26506/80, etc.; tertiary amines as described in Japanese Patent Application (OPI) No. 84440/73, etc.; thiocarbamoyls as described in Japanese Patent Application (OPI) No. 42349/74, etc., may be employed individually or in combination of two or more thereof. Bromine ions, iodine ions, thioetherseries compounds and disulfide-series compounds are preferred bleach accelerating agents. These bleach accelerating agents are particularly effective in the case wherein color photographic light-sensitive materials for photographing are subjected to bleach-fixing.

Examples of fixing agents include thiosulfates, thiocyanates, thioether-series compounds, thioureas, a large amount of iodides, etc. Of these compounds, thiosulfates are ordinarily employed. In the bleach-fixing solution or the fixing solution, sulfites, bisulfites, carbonylbisulfite adducts, etc., are preferably employed as preservatives.

After the bleach-fix processing or fix processing, water washing processing is typically conducted. In the water washing step, various known compounds ray be employed for the purpose of preventing precipitation, saving water, etc. For example, a water softener such as an inorganic phosphoric acid, an aminopolycarboxylic acid, an organic phosphoric acid, etc., for the purpose of preventing the formation of precipitation; a sterilizer or antimold for the purpose of preventing the propagation of various bacteria, algae and molds; a hardener such as a magnesium salt, an aluminum salt, etc.; or a surface active agent for the purpose of reducing the drying load, preventing drying marks, etc., may be added, if desired. Further, the compounds as described in L. E. West, "Water Quality Criteria", *Photo. Sci. and Eng.*, Vol. 6, pages 344 to 359 (1965) may be added. Particularly, the addition of chelating agents and antimolds is effective.

The water washing step is ordinarily carried out using a countercurrent water washing processing with two or more tanks, in order to save water. Further, in place of the water washing step, a multistage countercurrent stabilizing processing step as described in Japanese Patent Application (OPI) No. 8543/82 may be conducted. In the case of utilizing such a step, it is desirable to employ a countercurrent processing with two to nine tanks. To the stabilizing bath various kinds of compounds are added for the purpose of stabilizing images formed as well as the above-described additives. Representative examples of the additives include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., being used in combination) for the purpose of adjusting the pH of layers (for example, pH of 3 to 8), formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazolinones, isothiazolones, 4-thiazolinebenzimidazoles, halogenated phenols, etc.), surface active agents, brightening agents, hardening agents, etc., may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agent for layers after processing.

For the purpose of simplification and acceleration of processing, a color developing agent may be incorporated into the color photographic light-sensitive material according to the present invention. In order to incorporate the color developing agent, it is preferred to employ various precursors of color developing agents. Suitable examples of the precursors of developing agents include indoaniline-type compounds as described in U.S. Pat. No. 3,342,597, Schiff's base-type compounds as described in U.S. Pat. No. 3,342,599 and *Research Disclosure,* No. 14850 (August, 1976), and *Research Disclosure,* No. 15159 (November, 1976), aldol compounds as described in *Research Disclosure,* No. 13924 (November, 1975), metal salt complexes as described in U.S. Pat. No. 3,719,492, urethane-type compounds as described in Japanese Patent Application (OPI) No. 135628/78, and various salt type precursors as described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, 83565/82, etc.

Further, the color photographic light-sensitive material according to the present invention may contain, if desired, various 1-phenyl-3-pyrazolidones for the purpose of accelerating color development. Typical examples of such compounds include those as described in Japanese Patent Application (OPI) Nos. 64339/81, 144547/82, 211147/82, 50532/83, 50536/83, 50533/83, 50534/83, 50535/83, 115438/83, etc.

In the present invention, various kinds of processing solutions can be employed in a temperature range from 10° C. to 50° C. Although a standard temperature is from 33° C. to 38° C., it is possible to carry out the processing at higher temperatures in order to accelerate the processing, whereby the processing time is shortened, or at lower temperatures in order to achieve improvement in image quality and to maintain stability of the processing solutions.

Further, for the purpose of saving the amount of silver employed in the color photographic light-sensitive material, the photographic processing may be conducted utilizing color intensification, for example, using cobalt or hydrogen peroxide as described in West German Patent No. 2,226,770, U.S. Pat. No. 3,674,499, etc.

In each of the processing baths, a heater, a temperature sensor, a liquid level sensor, a circulation pump, a filter, a floating cover, a squeegee, etc., may be provided, if desired.

The present invention is described in greater detail with reference to the following examples, but the present invention is not to be construed as being limited thereto.

EXAMPLE 1

10 g of each of the yellow dye-forming couplers according to the present invention as shown in Table 1 below and comparative couplers as illustrated below were added to a mixture of 1.0 ml of an organic solvent having a high boiling point (di-n-butylphthalate or tricresyl phosphate) and 10 m of ethyl acetate, and the mixture was completely dissolved by heating at 60° C. The resulting solution was mixed with 10 ml of a 7% aqueous solution of sodium dodecylbenzenesulfonate and 150 ml of a 10% aqueous solution of gelatin, and the mixture was emulsified and dispersed using a colloid mill.

20 ml of the coupler dispersion thus prepared was put into a test tube and preserved in a thermostat at 20° C. for 48 hours. Using an integrated sphere type turbidimeter (manufactured by Nippon Seimitsukogaku Co., Ltd.), turbidity (%) of the dispersion was measured just after the preparation and after the preservation for 48 hours. Thus, the degree of deposition of the coupler was determined. The turbidity was obtained according to the following equation:

$$\text{Turbidity (\%)} = \frac{\text{Scattering Transmission Amount}}{\text{Total Transmission Amount}} \times 100$$

The results obtained are shown in Table 1 below.

Comparative Coupler (A)

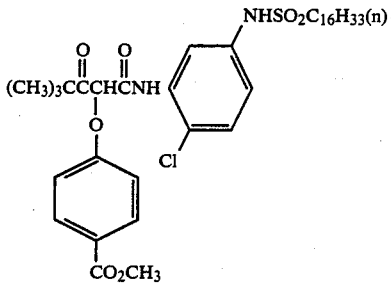

(described in U.S. Pat. No. 4,401,752).

Comparative Coupler (B)

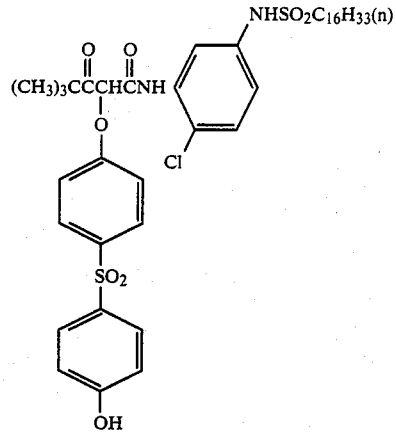

(described in U.S. Pat. No. 3,933,501).

Comparative Coupler (C)

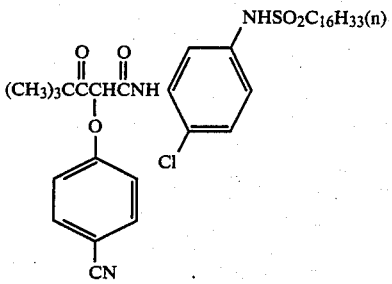

(described in U.S. Pat. No. 3,933,501).

Comparative Coupler (D)

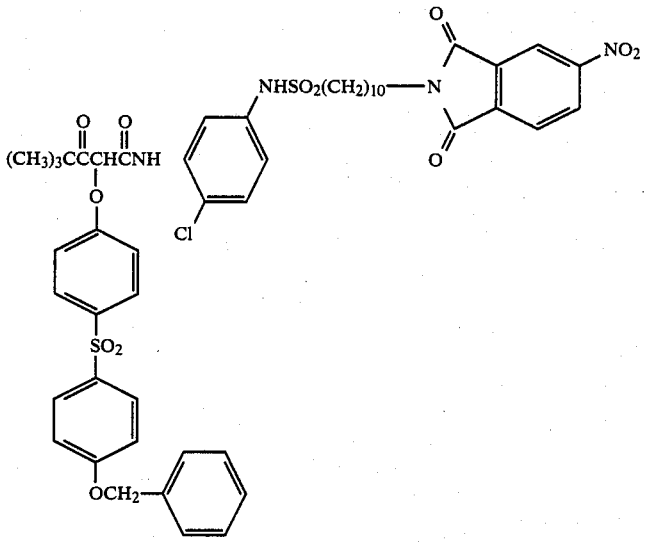

(described in Japanese Patent Application (OPI) No. 21738/83).

Comparative Coupler (E)

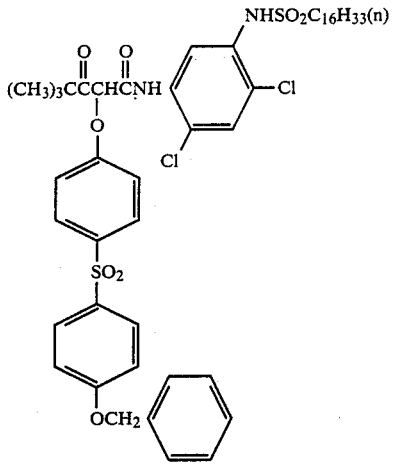

(described in Japanese Patent Application (OPI) No. 42046/83).

Comparative Coupler (F)

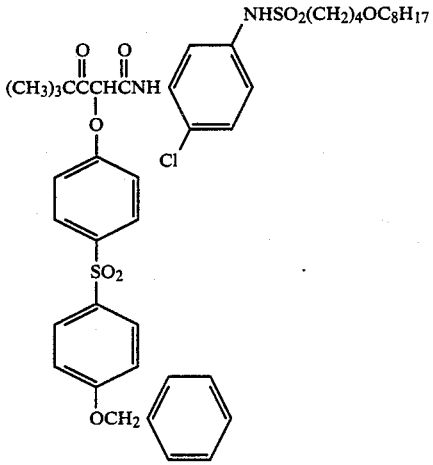

(described in Japanese Patent Application (OPI) No. 142340/80).

Comparative Coupler (G)

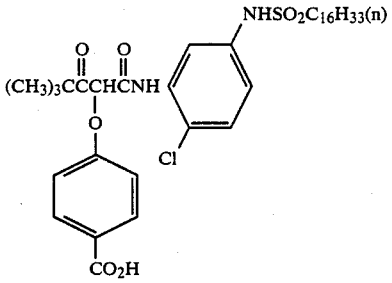

(describied in U.S. Pat. No. 3,894,875).

Comparative Coupler (H)

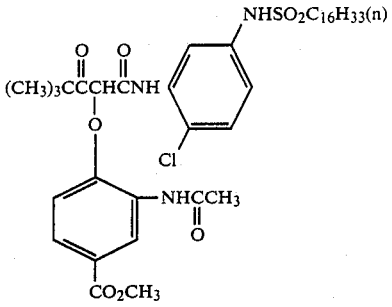

(described in U.S. Pat. No. 4,401,752).

Comparative Coupler (I)

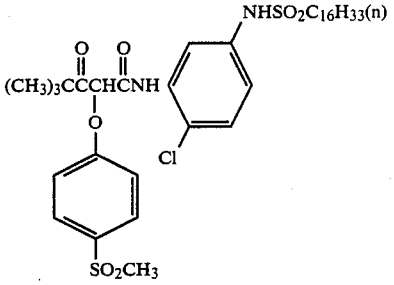

(described in U.S. Pat. No. 3,933,50).

Comparative Coupler (J)

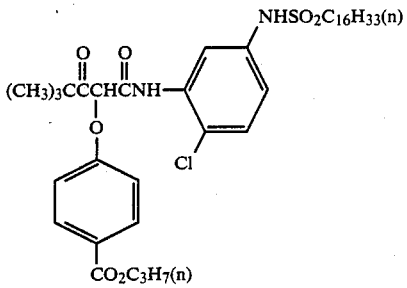

TABLE 1

| No. | Coupler | Organic* Solvent Having High Boiling Point | Turbidity Just after Preparation | Turbidity After 48 Hours |
|---|---|---|---|---|
| 1 | (1) | A | 17.0 | 17.3 |
| 2 | " | B | 17.5 | 17.5 |
| 3 | (3) | A | 18.1 | 18.1 |
| 4 | " | B | 18.0 | 18.3 |
| 5 | (5) | A | 16.3 | 16.3 |
| 6 | " | B | 16.1 | 16.2 |
| 7 | (12) | A | 18.2 | 18.7 |
| 8 | " | B | 18.1 | 18.3 |
| 9 | (13) | A | 15.3 | 15.8 |
| 10 | " | B | 16.8 | 16.9 |
| 11 | (17) | A | 18.3 | 18.3 |
| 12 | " | B | 17.6 | 19.1 |
| 13 | (23) | A | 15.4 | 17.1 |
| 14 | " | B | 17.1 | 18.0 |
| 15 | Comparative Coupler (A) | A | 19.8 | deposited |
| 16 | " | B | 19.5 | deposited |
| 17 | Comparative Coupler (B) | A | 17.3 | 53.4 |

TABLE 1-continued

| No. | Coupler | Organic* Solvent Having High Boiling Point | Turbidity Just after Preparation | Turbidity After 48 Hours |
|---|---|---|---|---|
| 18 | " | B | 18.1 | 59.6 |
| 19 | Comparative Coupler (C) | A | 17.8 | deposited |
| 20 | Comparative Coupler (D) | A | 20.5 | deposited |
| 21 | Comparative Coupler (E) | A | 17.3 | 83.0 |
| 22 | Comparative Coupler (F) | A | 18.5 | 31.0 |
| 23 | " | B | 18.3 | 33.0 |
| 24 | Comparative Coupler (G) | A | 19.3 | 90.5 |
| 25 | Comparative Coupler (H) | A | 18.5 | 89.0 |
| 26 | Comparative Coupler (I) | A | 18.3 | 90.3 |
| 27 | " | B | 17.5 | 95.4 |
| 28 | Comparative Coupler (J) | A | 19.5 | deposited |
| 29 | " | B | 19.0 | deposited |

*A: Di-n-butyl phthalate
B: Tricresyl phosphate

It can be seen from the results shown in Table 1 that the yellow dye-forming couplers according to the present invention are excellent in stability of dispersion of the coupler during preservation as compared with the comparative couplers.

EXAMPLE 2

On a cellulose acetate film support were coated layers having the compositions set forth below, to prepare a photographic light-sensitive material.

First Layer

A yellow dye-forming coupler and an organic solvent having a high boiling point were mixed and to the mixture was added ethyl acetate, which was dissolved by heating. The solution was emulsified and dispersed in an aqueous solution of gelatin containing a surface active agent (sodium dodecylbenzenesulfonate) to prepare an emulsified dispersion of yellow coupler. The dispersion of yellow coupler was mixed with a silver iodobromide emulsion (silver iodide: 3 mol %) at a molar ratio of silver/coupler of 3.5/1 to prepare a coating solution.

Second Layer

To an aqueous solution of gelatin were added a hardening agent [1,3-bis(vinylsulfonyl)-2-propanol] and a surface active agent to prepare a coating solution.

The yellow dye-forming coupler and the organic solvent having a high boiling point used in the first layer was altered to those as shown in Table 2 below to prepare Samples 101 to 110, respectively. The coating amount of the coupler was adjusted to 2 g/m$^2$.

These samples were exposed to blue light and subjected to development processing according to the following processing steps.

| Processing Steps | Time (min) | Temperature |
|---|---|---|
| First Development | 6 | 38° C. |
| Washing with Water | 2 | " |
| Reversing | 2 | " |
| Color Development | 6 | " |
| Conditioning | 2 | " |
| Bleaching | 6 | " |
| Fixing | 4 | " |
| Washing with Water | 4 | " |
| Stabilizing | 1 | Normal Temperature |
| Drying | | |

The composition of each processing solution used was as follows.

| | |
|---|---|
| First Developing Solution: | |
| Water | 700 ml |
| Pentasodium Salt of Nitrilo-N,N,N—trimethylenephosphonic Acid | 2 g |
| Sodium Sulfite | 20 g |
| Hydroquinone.Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| Reversing Solution: | |
| Water | 700 ml |
| Pentasodium Salt of Nitrilo-N,N,N—trimethylenephosphonic Acid | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developing Solution: | |
| Water | 700 ml |
| Pentasodium Salt of Nitrilo-N,N,N—trimethylenephosphonic Acid | 3 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| 3,6-Dithiaoctane-1,8-diol | 1 g |
| Water to make | 1,000 ml |
| Conditioning Solution: | |
| Water | 700 ml |
| Sodium Sulfite | 12 g |
| Sodium Ethylenediaminetetraacetate (dihydrate) | 8 g |
| Thioglycerol | 0.4 ml |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2 g |
| Iron (III) Ammonium Ethylenediaminetetraacetate (dihydrate) | 120 g |
| Potassium Bromide | 100 g |
| Water to make | 1,000 ml |
| Fixing Solution: | |
| Water | 800 ml |
| Sodium Thiosulfate | 80 g |
| Sodium Sulfite | 5 g |
| Sodium Bisulfite | 5 g |
| Water to make | 1,000 ml |
| Stabilizing Solution: | |
| Water | 800 ml |
| Formalin (37 wt % formaldehyde) | 5 ml |
| Fuji Driwel (a nonionic surface active agent manufactured by Fuji Photo Film Co., Ltd.) | 5 ml |
| Water to make | 1,000 ml |

After the development processing, the maximum density ($D_{max}$) was measured with these samples. Further, light fastness of these samples was measured in the following manner. The sample was stored in a fluorescent lamp fading tester of $1.6\times10^4$ lux for 300 hours, and the light fastness was indicated using a percent (%) of density after the test to the initial density of 1.0 being taken as 100%. The results obtained are shown in Table 2 below.

TABLE 2

| Sample No. | Coupler | Organic Solvent Having High Boiling Point (weight ratio to coupler) | $D_{max}$ | Light Fastness (%) |
|---|---|---|---|---|
| 101 (Invention) | (2) | Dibutyl phthalate (0.5) | 2.51 | 90 |
| 102 (Invention) | " | Not used | 2.48 | 85 |
| 103 (Invention) | (12) | Dibutyl phthalate (0.5) | 2.60 | 92 |
| 104 (Invention) | " | Not used | 2.54 | 86 |
| 105 (Invention) | (30) | Dibutyl phthalate (0.5) | 2.37 | 90 |
| 106 (Invention) | " | Not used | 2.32 | 84 |
| 107 (Comparison) | Comparative Coupler (A) | Dibutyl phthalate (0.5) | 1.92 | 85 |
| 108 (Comparison) | Comparative Coupler (A) | Not used | 1.65 | 76 |
| 109 (Comparison) | Comparative Coupler (J) | Dibutyl phthalate (0.5) | 2.21 | 82 |
| 110 (Comparison) | Comparative Coupler (J) | Not used | 1.93 | 74 |

It is clear from the results shown in Table 2 that Samples 101 to 106 according to the present invention are excellent in both color density and light fastness, as compared with Samples 107 to 110 for comparison. These differences are particularly remarkable in the case wherein an organic solvent having a high boiling point (dibutyl phthalate) is not employed.

EXAMPLE 3

Samples 201 to 205 were prepared in the same manner as described in Example 2, except for using an emulsified dispersion of a yellow dye forming coupler as shown in Table 3 below and tricresyl phosphate at the weight ratio of organic solvent/coupler being 1/0.05. Each of these samples were divided into four portions, and they were subjected to conventional stepwise exposure and then development processing as shown in Example 2. At the color development step, four color developing solutions adjusted pH at 10.0, 10.5, 11.0, and 11.5 using a conventional method, respectively, were employed. In Table 3 below, $D_{max}$ values of the thus-processed samples are set forth.

TABLE 3

| Sample No. | Coupler | $D_{max}$ Obtained from Color Developing Solution Having pH of | | | |
|---|---|---|---|---|---|
| | | 11.0 | 10.5 | 11.0 | 11.5 |
| 201 | (1) | 2.48 | 2.50 | 2.53 | 2.54 |
| 202 | (15) | 2.59 | 2.59 | 2.61 | 2.61 |
| 203 | (39) | 2.46 | 2.52 | 2.55 | 2.58 |
| 204 | Comparative Coupler (B) | 2.01 | 2.11 | 2.26 | 2.32 |
| 205 | Comparative Coupler (E) | 1.54 | 1.78 | 2.03 | 2.20 |

From the results shown in Table 3, it can be seen that Samples 201 to 203 according to the present invention are less susceptible to the variation of pH of the color developing solution over a range from 10.0 to 11.5 in comparison with Samples 204 and 205 for comparison. While only one kind of color developing solution is used in this example, similar results are obtainable in the case of employing other kinds of color developing solutions. While the invention has been described in detail and with reference to specific embodiments thereof, it will be apparent to one skilled in the art that various changes and modifications can be made therein without departing from the spirit and scope

What is claimed is:

1. A silver halide color photographic material comprising a support having thereon at least one silver halide emulsion layer, wherein the silver halide color photographic material contains at least one yellow dye-forming coupler represented by the formula (I)

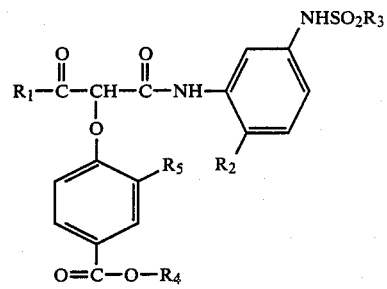

(I)

wherein $R_1$ represents a substituted or unsubstituted tertiary alkyl group or a substituted or unsubstituted aryl group; $R_2$ represents a chlorine atom or an alkoxy group; $R_3$ represents a straight chain or branched chain alkyl group having from 8 to 26 carbon atoms; $R_4$ represents a branched alkyl group having from 3 to 12 carbon atoms; and $R_5$ represents a hydrogen atom or a halogen atom.

2. A silver halide color photographic material as in claim 1, wherein $R_1$ represents a substituted or unsubstituted tertiary alkyl group.

3. A silver halide color photographic material as in claim 2, wherein $R_1$ represents a tert-butyl group.

4. A silver halide color photographic material as in claim 2, wherein a substituent for the substituted tertiary alkyl group represented by $R_1$ is selected from a halogen atom, an alkoxy group, an aryloxy group, an arylthio group, an alkylthio group, an alkylsulfonyl group, an arylsulfonyl group, an acylamino group, an amino group, and a cyano group.

5. A silver halide color photographic material as in claim 1, wherein $R_1$ represents a phenyl group.

6. A silver halide color photographic material as in claim 1, wherein a substituent for the substituted aryl group represented by $R_1$ is selected from a halogen atom, an alkoxy group, an aryloxy grcup, an arylthio group, an alkylthio group, an alkylsulfonyl group, an arylsulfonyl group, an ayclamino group, ar amino group, a cyano group, and an alkyl group.

7. A silver halide color photographic material as in claim 1, wherein the yellow dye-forming coupler is represented by the formula (II)

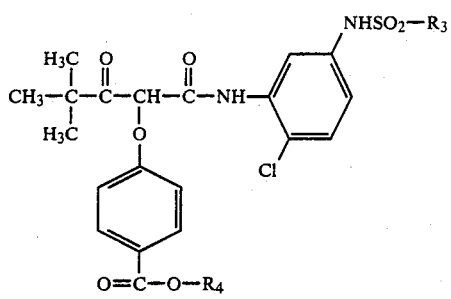

(II)

wherein $R_3$ and $R_4$ each has the same meaning as defined in claim 1.

8. A silver halide color photographic material as in claim 7, wherein $R_3$ represents a straight chain alkyl group having from 10 to 16 carbon atoms and $R_4$ represents a branched chain alkyl group having from 3 to 8 carbon atoms.

9. A silver halide color photographic material as in claim 1, wherein said yellow dye-forming coupler is present in the form of an oil droplet in water type dispersion with employing an organic solvent having a high boiling point, a mixture of the organic solvent with an auxiliary solvent, or the auxiliary solvent.

10. A silver halide color photographic material as in claim 9, wherein said organic solvent is represented by the formula (VI) or (VII)

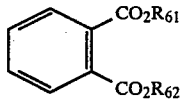

(VI)

wherein $R_{61}$ and $R_{62}$ each represents an alkyl group, a cycloalkyl group, an alkenyl group or an aryl group, and the total number of carbon atoms included in the groups represented by $R_{61}$ and $R_{62}$ is from 4 to 30;

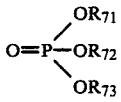

(VII)

wherein $R_{71}$, $R_{72}$ and $R_{73}$ each represents an alkyl group, a cycloalkyl group, an alkenyl group or an aryl group, and the total number of carbon atoms included in the groups represented by $R_{71}$, $R_{72}$ and $R_{73}$ is from 12 to 60.

11. A silver halide color photographic material as in claim 10, wherein a ratio by weight of the organic solvent/the yellow dye-forming coupler is not more than 0.5/1.

12. A silver halide color photographic material as in claim 11, wherein said ratio is not more than 0.2/1.

13. A silver halide color photographic material as in claim 12, wherein said ratio is not more than 0.05/1.

14. A silver halide color photographic material as in claim 9, wherein only the auxiliary solvent is employed.

15. A silver halide color photographic material as in claim 1, wherein the yellow dye-forming coupler is present in a silver halide emulsion layer.

16. A silver halide color photographic material as in claim 15, wherein the silver halide emulsion layer is a blue-sensitive silver halide emulsion layer.

17. A silver halide color photographic material as in claim 16, wherein the blue-sensitive silver halide emulsion layer contains at least one dye selected from a merocyanine dye and a cyanine dye represented by the formula (VIII-1), (VIII-2), (IX) or (X)

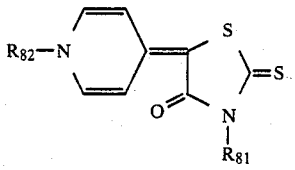

(VIII-1)

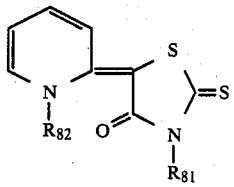

(VIII-2)

wherein $R_{81}$ represents an unsubstituted or substituted alkyl group, an unsubstituted or substituted aryl group, an unsubstituted or substituted aralkyl group, an unsubstituted or substituted alkenyl group or an allyl group; and $R_{82}$ represents an unsubstituted or substituted alkyl group, an unsubstituted or substituted alkenyl group or an allyl group;

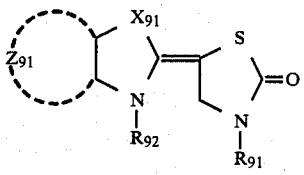

(IX)

wherein $R_{91}$ has the same meaning as defined for $R_{81}$ in the formula (VIII-1); $R_{92}$ has the same meaning as defined for $R_{82}$ in the formula (VIII-1); $X_{91}$ represents an oxygen atom or a sulfur atom; and $Z_{91}$ represents an atomic group forming a benzene ring or a naphthalene ring;

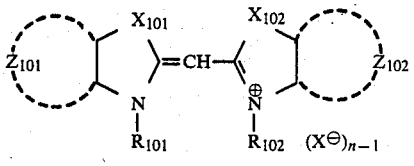

(X)

wherein $X_{101}$ and $X_{102}$ each represents an oxygen atom or a sulfur atom; $R_{101}$ and $R_{102}$ each has the same meaning as defined for $R_{82}$ in the formula (VIII-1); Z101 and $Z_{102}$ each has the same meaning as defined for Z91 in the formula (IX); represents an anion; and n represents 1 or 2.

18. A silver halide color photographic material as in claim 16, wherein the silver halide color photographic material further comprises at least one green-sensitive silver halide emulsion layer containing at least one magenta dye-forming coupler and at least one red-sensitive silver halide emulsion layer containing at least one cyan dye-forming coupler.

19. A silver halide color photographic material as in claim 18, wherein the magenta dye-forming coupler is selected from a polymerized 5-pyrazolone magenta coupler, a pyrazoloazole magenta coupler, and a polymerized pyrazoloazole magenta coupler.

20. A silver halide color photographic material as in claim 18, wherein the cyan dye-forming coupler is selected from a naphthoic cyan coupler and a phenolic cyan coupler.

21. A silver halide color photographic material as in claim 20, wherein the cyan dye-forming coupler is a phenolic cyan coupler having an acylamino group substituted with a fluorine atom at the 2-position of the phenol nucleus and an unsubstituted acylamino group having from 8 to 30 carbon atoms or an acylamino group substituted with a phenoxy group having from 6 to 28 carbon atoms at the 5-position thereof.

22. A silver halide color photographic material as in claim 18, wherein at least one layer selected from the blue-sensitive silver halide emulsion layer and layers adjacent thereto contains at least one compound having both a hindered amine moiety structure and a hindered phenolic moiety structure in its molecule, at least one layer selected from the green-sensitive silver halide emulsion layer and layers adjacent thereto contains at least one compound selected from a spiroindane and a chroman substituted with a hydroquinone diether or monoether, and at least one layer selected from the red-sensitive silver halide emulsion layer and layers adjacent thereto contains at least one ultraviolet ray absorbent.

* * * * *